United States Patent [19]

Sickels

[11] Patent Number: 4,605,088

[45] Date of Patent: Aug. 12, 1986

[54] MULTIDIRECTIONAL SOUND ABSORBER

[75] Inventor: Anthony R. Sickels, Dayton, Ohio

[73] Assignee: Soundfold, Inc., Dayton, Ohio

[21] Appl. No.: 670,242

[22] Filed: Nov. 13, 1984

[51] Int. Cl.[4] ..... E04B 1/99

[52] U.S. Cl. ..... 181/30; 181/290; 181/294; 181/295

[58] Field of Search ..... 181/30, 210, 284, 286, 181/290, 291, 295; 160/382, 166 R, 166 A, 173, 177; 52/208, 211, 144, 145; 403/292, 363

[56] References Cited

U.S. PATENT DOCUMENTS

| | | | |
|---|---|---|---|
| 2,285,423 | 6/1942 | Esser | 181/290 |
| 2,419,971 | 5/1947 | Rumpf et al. | 181/290 X |
| 3,136,397 | 6/1964 | Eeckel | 52/145 X |
| 3,185,207 | 5/1965 | Humble | 160/382 |
| 3,611,653 | 10/1971 | Zinn | 181/290 X |
| 3,921,694 | 11/1975 | Galex | 160/166 A |
| 4,057,123 | 11/1977 | Erickson | 181/286 |
| 4,094,379 | 6/1978 | Steinberger | 181/284 |
| 4,095,669 | 6/1978 | Bond, Sr. | 181/210 |
| 4,496,024 | 1/1985 | Wolf et al. | 181/292 |
| 4,516,874 | 5/1985 | Yang et al. | 403/363 X |
| 4,531,609 | 7/1985 | Wolf et al. | 181/290 |

*Primary Examiner*—Benjamin R. Fuller

*Attorney, Agent, or Firm*—Biebel, French & Nauman

[57] ABSTRACT

A multidirectional sound absorber which is adapted to be mounted on an exterior surface of a wall and includes a substantially flat base made of a relatively low density, sound absorbing material, and an outer layer made of a relatively high density, sound absorbing material attached to the base and shaped to form a plurality of channels which, together with the base, form enclosed hollow chambers. A substantially flexible sheet of acoustically transparent material covers the outer face of the outer layer, and upper and lower track members which enclose the ends of the base and outer layer and are adapted to attach the assembly to an exterior surface of a wall. The base and outer layer preferably are made of fiber glass insulation material. Also in a preferred embodiment, a woven mat of fiber glass material is attached to the outer face of the outer layer, and the sheet is attached to the mat.

2 Claims, 6 Drawing Figures

FIG-1
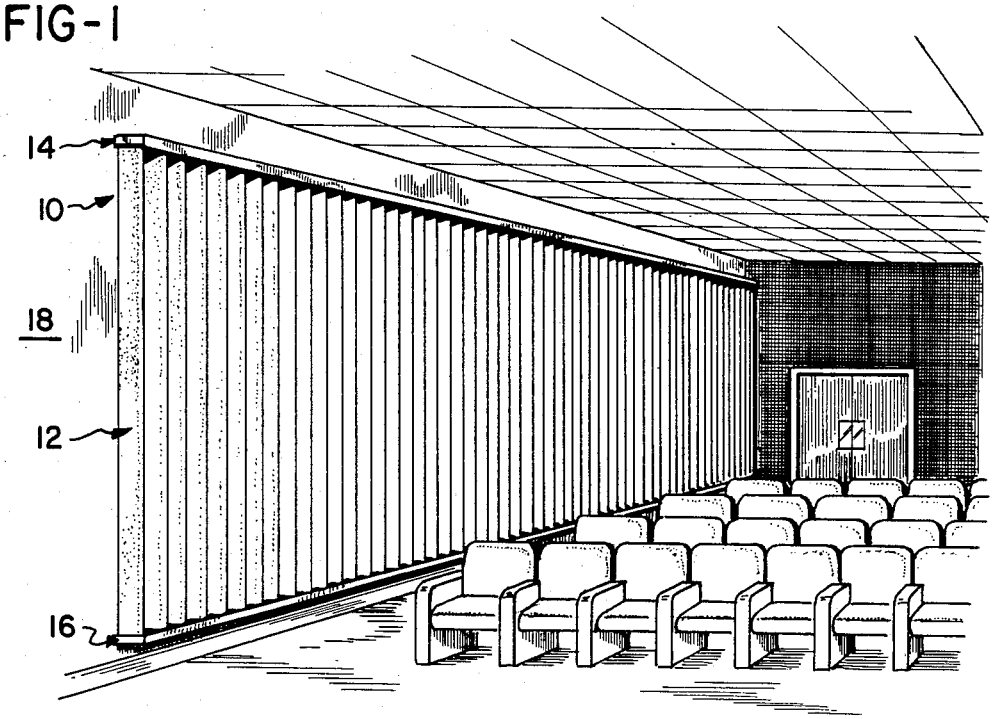
FIG-5
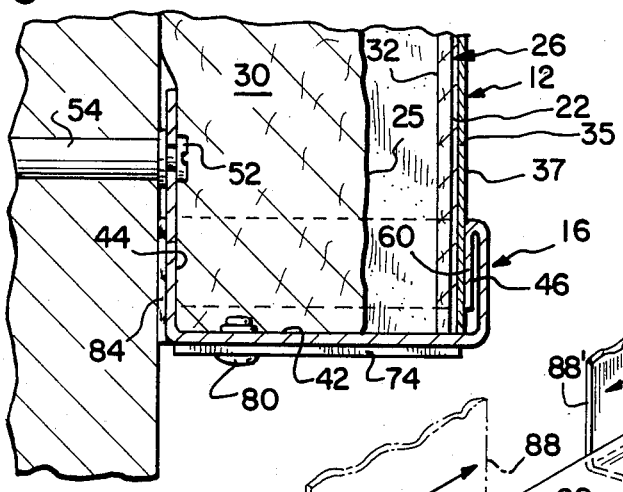
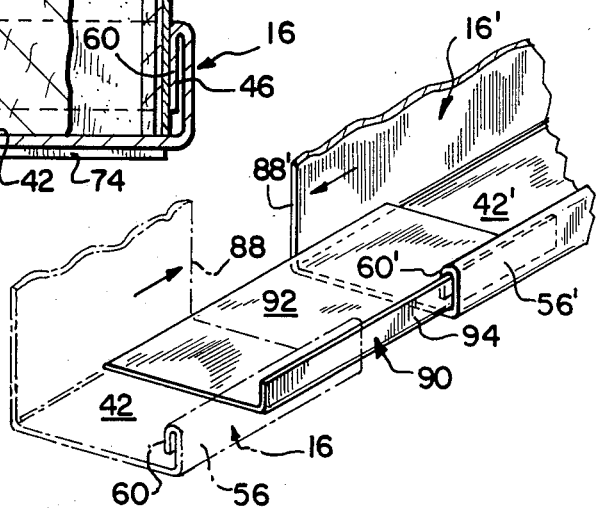
FIG-6

MULTIDIRECTIONAL SOUND ABSORBER

BACKGROUND OF THE INVENTION

The present invention relates to acoustical barriers and, more particularly, to sound absorbing structures adapted for use in occupied enclosures such as theaters, computer rooms, bowling centers and the like.

In order to maintain a comfortable noise level in rooms designed for occupancy by large numbers of people, the walls, floors and ceilings of such rooms are covered with an acoustical or sound absorbing material. Typically, floors are covered with carpeting and ceilings are fitted with acoustic ceiling tiles. However, these articles are unsuitable for use on the walls of such rooms. While the ceiling tiles possess acceptable sound absorbing capabilities, they are typically soft and susceptible to marring and damage by contact with the occupants of such rooms. Furthermore, ceiling tiles provide a poor appearance on walls. Carpeting, while possessing superior wear characteristics, is frequently unsuitable for use on the walls of rooms because its relatively high unit cost, relatively poor acoustic characteristics and unacceptable appearance.

Many attempts have been made to provide acoustic barriers which are either adapted to be mounted on the vertical walls of a room, or are designed to be freestanding and provide a vertical sound barrier. For example, the Humble U.S. Pat. No. 3,185,207 discloses an acoustic barrier which comprises a curtain of loose fabric which is attached to upper and lower brackets that are adapted to be mounted on the walls of a room. The brackets are shaped to form a saw tooth configuration so that the curtain they support hangs with a series of vertically extending, parallel pleats. A disadvantage with this structure is that the fabric alone does not possess high acoustic properties and is incapable of absorbing sound to a high degree. Another disadvantage of such a structure is that the fabric curtain hangs unsupported between the upper and lower brackets and often can sag or become ripped or wrinkled. In addition, the curtain material is often difficult to trim neatly at the top and bottom.

Another type of acoustic device is shown in the Steinberger U.S. Pat. No. 4,094,379. That device is a sound absorbing panel designed to be freestanding in a room and comprising a framework of a sound reflecting material, which preferably is transparent, forming a series of vertically extending pockets. Within each of a pockets is a strip of sound absorbing material which is positioned to absorb the sound reflected from the interior pocket walls of the framework.

A disadvantage with this type of structure is that it is relatively expensive to manufacture and contains a relatively small proportion of sound absorbing material. It should also appear that the device is not capable of absorbing soundwaves emanating from all directions, but rather is limited to soundwaves traveling in a relatively restricted area directly in front of the open pockets, since the sound waves must be reflected into the sound absorbing material.

An apparent disadvantage of both of the aforementioned structures is that only a single type of acoustic material is employed, and that material has a relatively uniform density. Since the type and density of acoustic material often determines the efficiency at which it absorbs sound in a given frequency range, a sound absorbing structure having a single sound absorbing material of a single or uniform density would be efficient at absorbing sound in only a few or perhaps a single frequency range, while operating less efficiently in absorbing sound in other frequency ranges.

Accordingly, there is a need for a sound absorbing structure adapted for use in occupied rooms which is sufficiently wear-resistant to withstand occasional contact with the occupants of the room, and yet is relatively inexpensive to manufacture and install. Furthermore, there is a need for such a sound absorbing structure which is capable of absorbing sound efficiently in a number of different frequency ranges. In addition, since such a sound absorbing panel will form an integral part of the design of an occupied room, it should present an aesthetically pleasing appearance and be capable of modification to suit different design and color schemes.

SUMMARY OF THE INVENTION

The present invention is a multidirectional sound absorber which includes a base made of a relatively low density sound absorbing material and an outer layer made of a relatively high density sound absorbing material. The outer layer forms a plurality of vertically extending channels which, together with the base, comprise a series of hollow chambers. Each hollow chamber, therefore, includes a rear wall of a relatively low density material and outer walls of relatively high density material. The chambers preferably are triangularly-shaped in cross section which adds strength to the overall structure and increases the surface area of the outer layer.

The sound absorber also includes a layer of flexible, acoustically transparent fabric which is attached by an adhesive to the outer surface of the outer layer. The fabric adds a necessary aesthetic appearance to the structure and is capable of being dyed in a variety of colors so that the sound absorber may be adapted to a wide variety of decors. Furthermore, the outer fabric layer is preferably constructed of a wear-resistant material so that the outer layer of sound absorbing material is protected from abrasion.

The base and outer layer together form a rigid panel, and the sound absorber includes upper and lower track members which are shaped to enclose the ends of the panel and the hollow chambers. The track members include means, such as bolts, for mounting the entire assembly on the exterior surface of a wall so that an inner surface of the base abuts the wall. The track members are each preferably made from a single sheet of metal, such as anodized aluminum, which is bent to form a closed channel shape. The track members preferably include a floor which supports the associated end of the panel, a front wall which extends across the front edge of the panel, a rear wall including mounting holes, and side walls for protecting the side edges of the panel.

Although the exact mechanism of its operation is not completely understood, it is believed that the relatively high density outer layer of the panel absorbs sound in certain frequency ranges, while permitting sound in other frequency ranges to pass through into the hollow chambers. The transmitted sound within the hollow chambers is then absorbed by the relatively low density base.

In a preferred embodiment, both the base and outer layer are made of fiber glass insulation material in which the outer layer is compressed during formation to a relatively high density. The base is not compressed to the same degree to maintain a relatively low density. The outer layer includes a thin web of woven fiber glass bonded to its outer surface, which forms a smooth substrate for the fabric and enhances the appearance of the finished product.

Another advantage of the present invention over presently known devices is that, when properly mounted on an exterior surface of a wall, it is capable of absorbing sound from virtually any direction which might normally impinge upon the supporting wall. There are no "dead" or sound reflecting areas on the panel, and the track members comprise such a small proportion of the total surface area of the panel that any sound reflection they might create may be considered negligible.

Accordingly, it is an object of the present invention to provide a multidirectional sound absorbing panel which is relatively inexpensive to manufacture and install; a sound absorber which includes components of varying densities so that sound may be absorbed efficiently in several frequency ranges; a sound absorber which is sufficiently wear-resistant and rigid to be used on a wall of a room in which it is subjected to contact with the occupants of that room; a sound absorber which may be modified in appearance to conform with a variety of decors; and a sound absorber capable of absorbing sound emanating from a relatively wide area.

Other objects and advantages will be apparent from the following description, the accompanying drawings and the appended claims.

BRIEF DESCRIPTION OF THE DRAWINGS

FIG. 1 is a perspective view of the multidirectional sound absorber installed in a room;

FIG. 5 is a side elevation in section of a detail of the sound absorber taken at line 5—5 of FIG. 2; and FIG. 6 is a somewhat schematic perspective view of a connecting tab joining two track members together.

DETAILED DESCRIPTION OF THE PREFERRED EMBODIMENT

Figure 2:
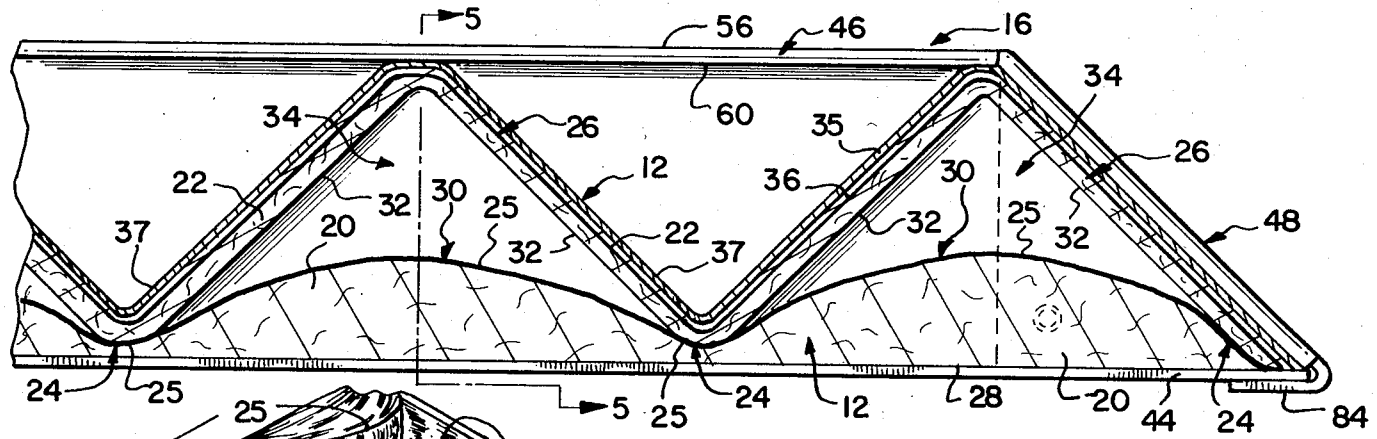
FIG. 2 is a detail showing a partial cross section of the sound absorber of FIG. 1.

As shown in FIG. 1, the multidirectional sound absorber, generally designated 10, includes a panel 12 which is contained within upper and lower track members 14, 16, respectively. The sound absorber 10 is mounted on the exterior surface of a wall 18 of a room, such as a theater as shown in FIG. 1. Although it appears from FIG. 1 that a single panel 12 is employed, it is preferable to fabricate the panel in easily-handled sections which are held between the track members 14, 16 in abutting relation to form a continuous structure. The invention may also be used in the form of smaller, individual panels as an applique in critical sound areas.

Figure 3:
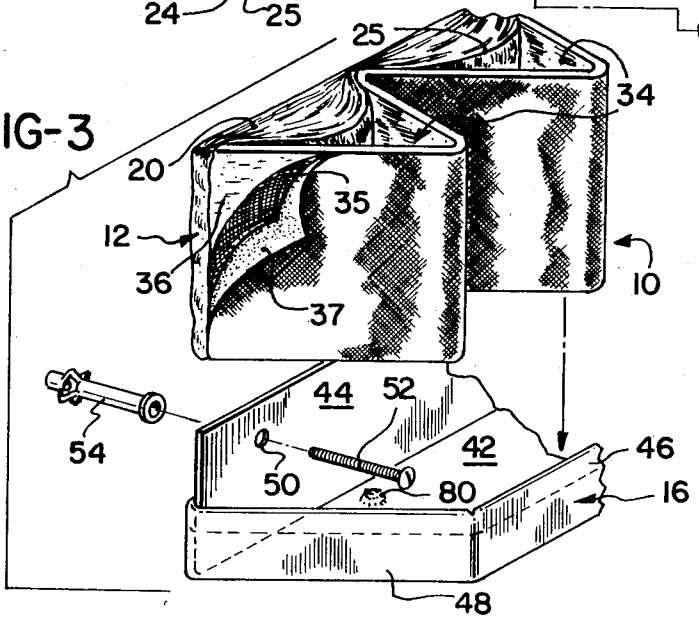
FIG. 3 is an exploded, perspective view of a detail of the sound absorber of FIG. 1.

As shown in FIGS. 2 and 3, the sound absorber panel 12 includes a substantially flat, plate-shaped base 20 made of a relatively low density fiber glass insulation material, such as, for example, a 5 lb. density fiber glass. An outer layer 22, made of a relatively high density fiber glass insulation material, is attached to the base 20 at locations 24 by an interposed layer 25 of polyethylene fiber, such as Visqueen (a trademark of Ethyl Corp., Richmond, Va.). Preferably, the outer layer 22 is made of the same fiber glass insulation material, but is compressed to a high density during formation such as, for example, a 15 lb. density fiber glass. The outer layer 22 is shaped to form a plurality of V-shaped channels 26 which provide increased surface area for the outer layer and add rigidity to the panel 12.

The base 20 includes inner and outer surfaces 28, 30, respectively. The inner surface 28 is relatively planar in shape so as to conform to the flat surface of the wall 18 (FIG. 1). The outer surface 30 of the base 20 acts with the inner faces 32 of the channels 26 to form hollow chambers 34. The hollow chambers 34 are generally triangular in shape and extend vertically between the upper and lower track members 14, 16.

In order to adapt the aforementioned panel 12 to be mounted on a wall, a woven fiber glass mat 35 is attached to the outer faces 36 of the channels 26. The mat preferably has a thickness on the order of a few mils (0.0025 cm). A sheet of acoustically transparent fabric 37 is attached to the outer faces of the channels 26 so that it covers the entire outer layer 22. In a preferred embodiment, the fabric 37 is a relatively loose weave of 100% polyester, having a weight of 18.5 ounces per lineal yard. Other acceptable materials are "panel flannel" (70% wool, 25% polyester, 5% polyacrylic) and 100% jute (burlap). All such fabrics should be Class A fire rated. The fabric 37 preferably is attached to the mat 37, and the mat to the outer faces 36, by web adhesive (not shown) such as Sharnet 4200, manufactured by Sharnet Corp., Ward Hill, Mass. Such an adhesive is fabricated from 100% solid adhesives into a "network" form, and is activated by the application of heat. An advantage of the web is that it is substantially acoustically transparent. The fabric 37 preferably is dyed to match the decor of the room in which the assembly 10 is mounted.

Figure 4:
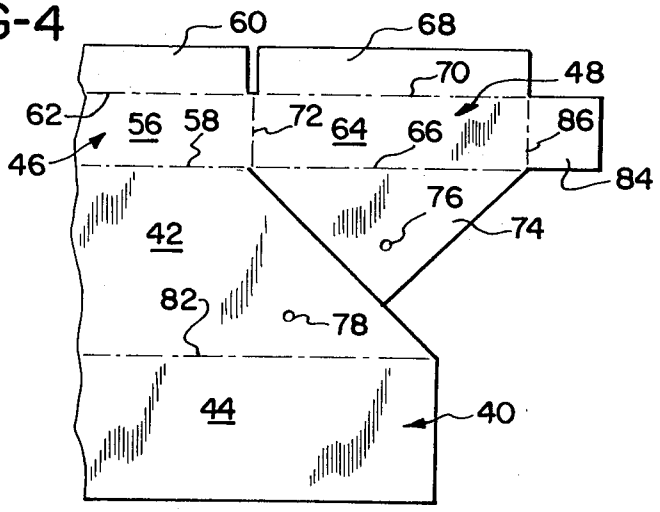
FIG. 4 is a detail showing a blank cut to form a track member of the sound absorber end cap of FIG. 1.

As shown in FIGS. 3, 4 and 5, the lower track member 16 is made from a one-piece blank 40 of metal such as anodized aluminum. While the following description of the track members is directed to lower track member 16, it should be noted that the description and features apply as well to the upper track member 14. The lower track member 16 includes a floor 42, a rear wall 44 extending upwardly from a rear edge of the floor, a front wall 46 extending upwardly from a front edge of the floor, and a side wall 48 extending upwardly from a side edge of the floor and abutting the front and rear walls. The rear wall 44 includes a hole 50 sized to receive a mounting bolt 52. The mounting bolt 52 is threaded into a wall anchor 54 of well-known design.

The assembly of the track member 16 from the blank 40 is best shown in FIGS. 4 and 5. The front wall 46 is formed by bending panel 56 upwardly from the floor 42 at fold line 58, then folding over flap 60 at fold line 62. The side wall 48 is formed by folding panel 64 at fold line 66, then folding flap 68 at fold line 70. The folded structure is bent toward the floor 42 at fold line 72 so that the flap 74 extends beneath the floor until hole 76 thereon is in registry with hole 78 in the floor. The side wall 48 can be secured in position by inserting a rivet 80 (FIG. 3) through the holes 76, 78. The rear wall 44 is bent upwardly from the floor 42 at fold line 82, and a tab 84, which extends outwardly from panel 64, is bent around the rear wall 44 at fold line 86 to secure the side wall 48 to the rear wall, as shown in FIGS. 2 and 5.

Thus, the side wall 48 conforms in shape to the slope of the end outer face 32 of channel 26. In cross section, the track member 16 is U-shaped, such that the front and rear walls 46, 44 are parallel to each other and normal to the floor 42. Side wall 48 is normal to the floor 42 as well.

As shown in FIGS. 2 and 6, the front wall 46 and rear wall 44 extend continuously to an opposite end of the tray member 16. If the assembly is to be longer than a single section of the track member 16, a track member having a squared end 88, shown in FIG. 6, is used and it abuts a similar squared end 88' of an adjacent track member 16'. A connecting tab 90 is used to join the two track members 16, 16' together, and includes a base 92 which is shaped to overlay the floors 42, 42' of the track members, and a front section 94, which is shaped to slidably engage the space between the flaps 60, 60' and front panels 56, 56' of the track members.

Although not shown specifically in the drawings, intermediate track members may be employed having ends similar in construction to end 88 of track member 16, so that any number of track members may be employed to form a continuous track. On an opposite end of the track member, a section is utilized having a stamping identical to that shown in FIG. 4, but of reverse hand, so that a sloping end wall which conforms to the slope of the channels 26 is formed.

An advantage of the disclosed construction of the upper and lower track members 14, 16 is that the track member is shaped to receive an end of the panel 12 such that the upper and lower ends of the base 20, outer layer 22 and channels 26 are fully enclosed and protected. Furthermore, the walls which are exposed to occupants of the room in which the sound absorber 10 is mounted are free of sharp edges which may snag clothing or injure the occupants.

While the form of apparatus herein described constitutes a preferred embodiment of this invention, it is to be understood that the invention is not limited to this precise form of apparatus, and that changes may be made therein without departing from the scope of the invention.

What is claimed is:

1. For use on an exterior surface of a wall, a multidirectional sound absorber comprising:

a substantially flat base including a continuous, imperforate sheet of fiber glass compressed to a relatively low density and having inner and outer surfaces;

an outer layer including a continuous, imperforate sheet of fiber glass compressed to a relatively high density and forming a plurality of channels having inner and outer faces and attached to said base such that said channels form a plurality of hollow chambers therewith;

a sheet of acoustically transparent, relatively abrasion-resistant material attached to said outer faces of said channels;

track means for enclosing upper and lower ends of said base and channels and including means for mounting said track means on an exterior of a wall, said track means having upper and lower track members, each of said track members including a one-piece blank having a floor with an end surface beveled to conform to a slope of said outer face of an end one of said channels, an elongate rear wall attached to said floor at a first fold line, an elongate front wall attached to said floor opposite said front wall at a second fold line, a side wall attached to said front wall at a third fold line, a first, substantially triangularly-shaped tab attached to said side wall at a fourth fold line, a tap attached to an end of said side wall opposite said front wall at a fifth fold line, and first and second elongate flaps attached to said front and side walls opposite said floor and said triangularly-shaped tab at sixth and seventh fold lines, respectively.

2. For use on an exterior surface of a wall, a multidirectional sound absorber comprising:

a panel having an inner portion of fiber glass and an outer layer of acoustically transparent, relatively abrasion-resistant material attached to said inner portion, said panel having upper and lower open ends; and upper and lower track means for enclosing said open ends, each of said track means including a one-piece blank having a floor with an end surface beveled to conform to a slope of said outer face of an end one of said channels, an elongate rear wall attached to said floor at a first fold line, an elongate front wall attached to said floor opposite said front wall at a second fold line, a side wall attached to said front wall at a third fold line, a first, substantially triangularly-shaped tab attached to said side wall at a fourth fold line, a tab attached to an end of said side wall opposite said front wall at a fifth fold line, and first and second elongate flaps attached to said front and side walls opposite said floor and said triangularly-shaped tab at sixth and seventh fold lines, respectively.

* * * * *